US006611093B1

(12) United States Patent
Haven et al.

(10) Patent No.: US 6,611,093 B1
(45) Date of Patent: Aug. 26, 2003

(54) FIELD EMISSION DISPLAY WITH TRANSPARENT CATHODE

(75) Inventors: Duane A. Haven, Umpqua, OR (US); W. Edward Naugler, Jr., Menlo Park, CA (US)

(73) Assignee: Display Research Laboratories, Inc., Burlingame, CA (US)

( * ) Notice: Subject to any disclaimer, the term of this patent is extended or adjusted under 35 U.S.C. 154(b) by 0 days.

(21) Appl. No.: 09/664,873

(22) Filed: Sep. 19, 2000

(51) Int. Cl.[7] ..... H01J 1/30
(52) U.S. Cl. ..... 313/496; 313/309; 313/351
(58) Field of Search ..... 313/495, 496, 313/497, 309, 336, 351, 306

(56) References Cited

U.S. PATENT DOCUMENTS

| | | | | |
|---|---|---|---|---|
| 4,226,509 A | | 10/1980 | Jacobs | 350/343 |
| 4,940,916 A | | 7/1990 | Borel et al. | |
| 5,142,184 A | | 8/1992 | Kane | 313/309 |
| 5,396,150 A | | 3/1995 | Wu et al. | |
| 5,451,830 A | | 9/1995 | Huang | |
| 5,482,486 A | * | 1/1996 | Vaudaine et al. | 445/3 |
| 5,569,975 A | * | 10/1996 | Taylor et al. | 313/310 |
| 5,578,896 A | | 11/1996 | Huang | |
| 5,633,560 A | | 5/1997 | Huang | |
| 5,646,479 A | | 7/1997 | Troxell | 313/495 |
| 5,889,361 A | | 3/1999 | Wang et al. | 313/336 |
| 5,920,148 A | | 7/1999 | Potter | 313/309 |
| 6,037,708 A | | 3/2000 | Potter | 313/310 |
| 6,043,592 A | * | 3/2000 | Vaudaine | 313/309 |
| 6,130,503 A | * | 10/2000 | Negishi et al. | 313/495 |
| 6,133,690 A | * | 10/2000 | Meyer et al. | 313/495 |

FOREIGN PATENT DOCUMENTS

| | | |
|---|---|---|
| FR | 2 742 578 | 6/1997 |
| FR | 2 744 834 | 8/1997 |
| WO | WO 99/23679 | 5/1999 |

* cited by examiner

*Primary Examiner*—Ashok Patel
(74) *Attorney, Agent, or Firm*—Dorsey & Whitney LLP

(57) ABSTRACT

A field emission display which includes thin film resistors disposed between the electron-emitting elements of a cathode and a conductive support which provides electrical connection to said electron-emitting element through said thin film.

5 Claims, 9 Drawing Sheets

FIELD EMISSION DISPLAY WITH TRANSPARENT CATHODE

FIELD OF THE INVENTION

This invention relates generally to field emission displays, and more particularly to field emission displays having transparent cathodes.

BACKGROUND OF THE INVENTION

A type of cold cathode for field emission displays is described by C. A. Spindt, et. al. "Physical properties of thin film field emission cathode with molybdenum cones" in the Journal of Applied Physics, V47, No. 12. The described devices produce electrons by quantum mechanical tunneling from the emitter surface into a vacuum under the influence of a large electric field. The electron current generated by any emitter is described by the "Fowler-Nordheim" equation and is influenced by a number of factors including the work-function of the emitting surface and the physical shape and geometry of the emitter cone. These factors are caused by processing conditions and may result in a large degree of variability in emission current within a grouping of emitters.

Flat-panel, field-emission displays are typically addressed by electrical means. Referring to FIG. 1, a typical prior art display is illustrated with a voltage signal applied between a first conductive electrode 11 disposed on a non-conductive substrate 10 and a second conductive electrode 12 overlying the first conductive electrode. The first and second electrodes are electrically isolated from each other by means of electrically non-conductive dielectric layer 13 lying between the electrode layers. Emitter elements 14 disposed between the first and second electrodes are activated by differential signals applied between the electrodes 11 and 12 to cause electrons 15 to be emitted into a vacuum 20. The electrons are drawn to a light-emitting element 31 by the application of a voltage to an anode element 32.

Light emitting elements 31, opposite the electron-emitting elements 14, generate light responsive to bombardment by electrons emitted from the corresponding emitting element 14. Typically, a large number of electron-emitting elements are associated with each light-emitting element, which defines a pixel. The light-emitting elements 31 are carried by transparent conductive anode viewing screen 32 located parallel to, and spaced from, the electron-emitting elements 14. The anode viewing screen is typically formed on a transparent insulating substrate 30. The light-emitting elements are typically viewed through substrate 30 and transparent anode 32.

Since there can be a large variance in the emission current from emitter to emitter in any grouping or array of emitters, there can be a corresponding variation in the intensity of light emitted by the light-emitting elements. This variation in intensity causes degradation in picture quality.

In addition, current emission heats the emitter. The emission current increases as the temperature of the emitter increases causing a positive feedback condition which can result in the thermal destruction of the emitter and/or arcing of the emitter to the anode causing destruction of the display.

In order to limit current in any emitter and to normalize emission current within the grouping of emitters, Kane, (U.S. Pat. No. 5,142,184) describes the imposition of a series ballast resistor 16 between the first conductive electrode 11 and emitter element 14. The teachings of Kane, and other prior art, describe various configurations of resistive elements interconnecting, and disposed between, the first conductive electrode and the electron-emitting element. Typical prior art field emission displays, FIG. 2, comprise a plurality of substantially parallel first conductive electrodes 11 disposed in a generally horizontal direction on a non-conductive substrate, and a like plurality of second conductive electrodes 12 disposed in a direction generally perpendicular to, and overlying, the first conductive electrodes. The first and second electrode arrays are electrically isolated from each other by means of the electrically non-conductive dielectric layer 13 lying between the layers containing the electrode arrays. Electron-emitting elements 14 are disposed along each first conductive electrode at the intersection of the first and second conductive electrodes. When electrical signals are applied between first and second conductive electrodes, electrons are emitted from the electron-emitting elements located at the intersection of the first and second electrodes. Each electrode is made to be as narrow in width as possible to provide a large number of electrodes per display width. The resistance 17 of the electrode must be small in order to provide electrical addressing signals from one end of the electrode to the other without attenuation and consequent loss of signal fidelity. Consequently, electrodes are typically constructed from opaque metallic materials such as aluminum. Typical resistivities of these materials may be in the range of 2–5 micro-ohm-cm.

Referring to FIGS. 1 and 3, the ballast resistors 16 in series with the electron-emitting element and the first conductive electrode must be of a high resistance to provide sufficient retardation of excess current in the emitter element. This resistance is typically $10^5$ to $10^7$ Ohms. Ballast resistors 16 are electrically in parallel with the intrinsic series resistance 17 of the first conductive electrode 11. Ballast resistors must be significantly higher in resistance than the electrode resistance along the electrode from one grouping of emitters to any other grouping of emitters. This favorable ratio minimizes nonuniformity of electron emission as a function of distance along the electrode. This is shown schematically in FIG. 3 to provide illustration. A disadvantage of this type of ballasting is that the resistance of resistor 16 is dependent on geometry. FIG. 10 shows various construction errors encountered in the photoresist and etching processes used to define the placement and shape of elements 11, 14 and 16. FIGS. 10*a*, 10*b* and 10*c* show varying lengths of resistor 16 due to x and y deviations in photoresist mask alignment causing varying resistance from one display to another. FIG. 10*d* shows an alignment error through rotation of the cones 14 to the resistors 16 and metal line 11. This causes a high variation in ballast resistance and non-uniform emission. FIG. 10*e* show an abnormally thin ballast resistor 16 at emitter 14*a* due to undercutting of photoresist, and FIG. 10*f* shows a necking down of ballast resistor 16 at emitter 14*a* that can occur where a right angle is formed between two elements such as elements 11 and 16.

A second prior art display is described in U.S. Pat. No. 5,646,479, a portion of which is shown in the cross-sectional view, FIG. 4. This display is viewed so that the light emitting element 31 may be viewed through substrate 40. This configuration has several advantages, including the possibility of a reflective electrode 52. This is a technique well known in the art for increasing the amount of light emitted as a function of the electron beam current. This art describes a display comprising a transparent first electrode 41 on which is disposed and mounted a plurality of emitter cones 14. A second transparent, conductive electrode 42 is located plane-parallel to the first conductive transparent electrode and separated by a layer of dielectric material 13. An electrical signal applied between the first and second transparent conductive electrode causes electrons 15 to be emitted from the emitter cones 14 disposed on the first transparent conductive electrode. The resistivity of the transparent conductive electrode 41 is selected so as to provide electrical short protection in the event of such a failure at any emitter. However, as may be seen from the illustrative schematic representation, FIG. 5, the resistance 17 between the signal source and emitter cone 14 is a variable function of the distance between the cone and the location of the applied electrical signal 5. This variability in resistance can result in attenuation of electrical signal in the regions of highest resistance and increased emission current in the regions closest to the source of electrical signal application. This non-uniformity of electron emission can cause consequent loss of image quality when this structure is used as cathode in a display. Additionally, in order to achieve high light transmission through the transparent, conductive electrode, the conductive film must be thin. This increases the overall sheet resistance of the conductive film, limiting the maximum size of this type of display.

SUMMARY OF THE INVENTION

Accordingly, it is an object of the invention to provide a field emission display with uniformity of electron emission spatially distributed throughout the cathode.

It is another object to provide improved method for fabricating said cathode.

It is another object to provide a method for producing series emitter ballasting resistors that depend primarily on the thickness of the ballast material and not on the width and length.

It is another object to provide improved protection against electrical shorting between transparent conductive electrodes.

It is another object to provide for increased light transmission through said field emission cathode.

It is another object to reduce the resistance between the source of electrical signal and the location of the emitter cone.

There is provided a field emission display in which the cathode includes a ballast resistor between the electron-emitting cone and the first transparent conductive electrode which connects the cones to the source of the electrical signal, and in which the distributed resistance of the transparent conductive electrode is minimized by creation of a low-resistance region lying outside the region of electron-emitting cones.

DESCRIPTION OF THE DRAWINGS

The foregoing and other objects of the present invention will be more clearly understood from the following description when read in conjunction with the accompanying drawings in which.

DESCRIPTION OF THE INVENTION

Figure 1:
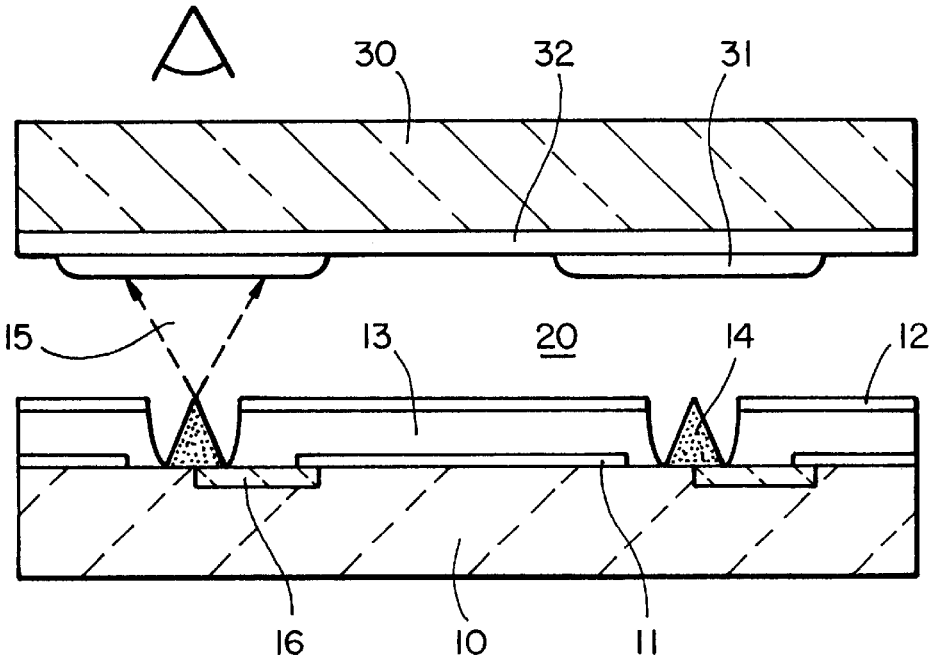
FIG 1 (PRIOR ART)
FIG. 1 is a cross-sectional view of a prior art field emission display.
Figure 2:
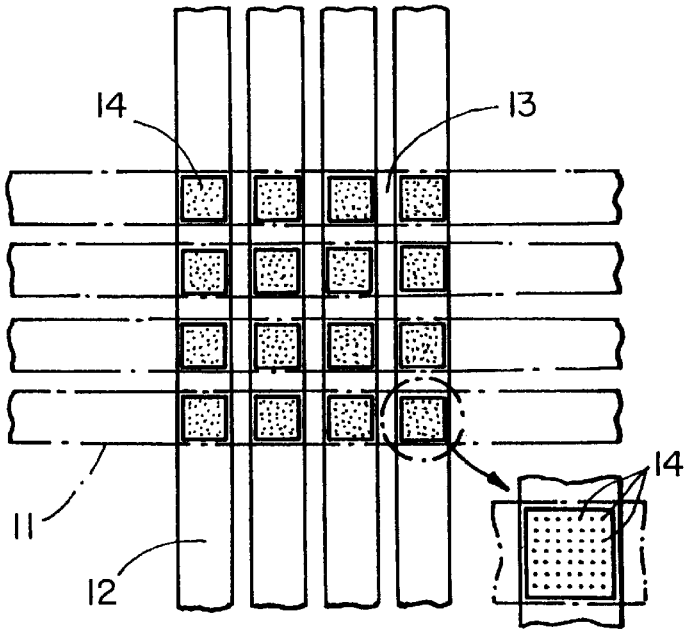
FIG 2 (PRIOR ART)
FIG. 2 is a plan view of a prior art field emission display.
Figure 3:
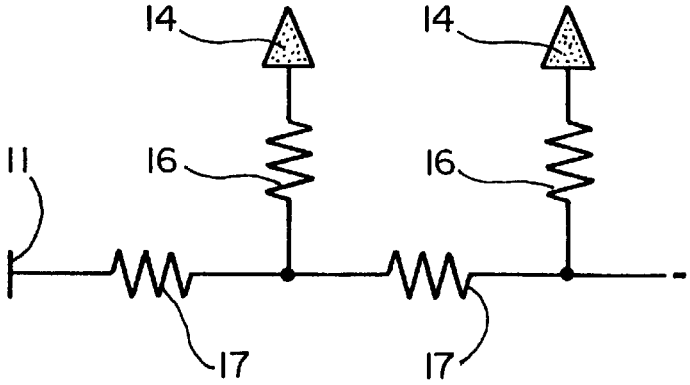
FIG 3 (PRIOR ART)
FIG. 3 is a schematic representation of the first conductive electrode and ballast resistance in a prior art field emitter.
Figure 4:
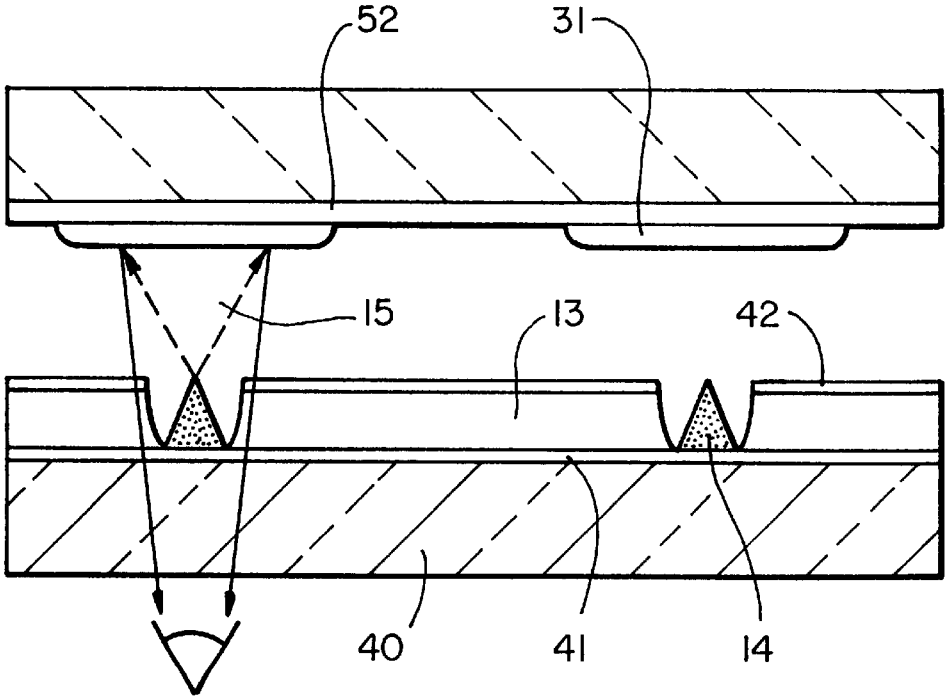
FIG 4 (PRIOR ART)
FIG. 4 is a cross-sectional view of a prior art field emission display with transparent electrodes.
Figure 5:
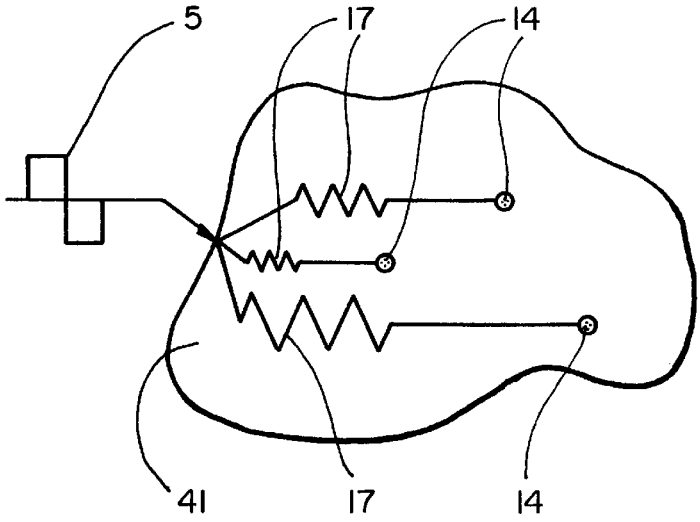
FIG 5 (PRIOR ART)
FIG. 5 is a schematic representation of the distributed resistance in the first transparent conductive electrode in a prior art field emitter cathode.
Figure 6:
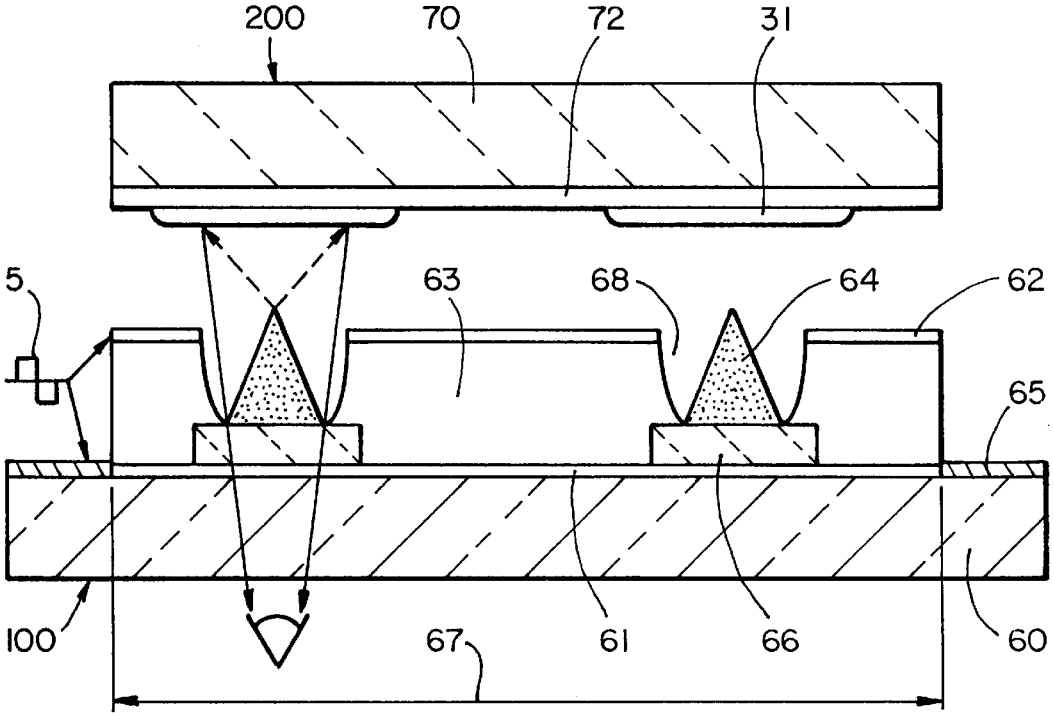
FIG. 6 is a cross sectional view of an embodiment of the invention.
Figure 7:
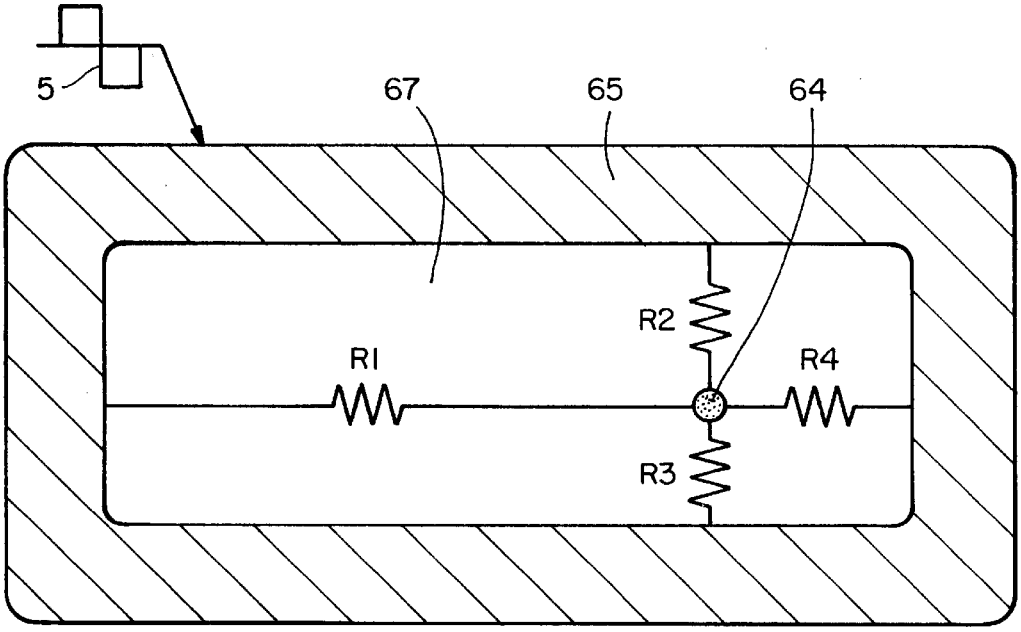
FIG. 7 is a plan view of a low resistance region of the first transparent conductive electrode in an embodiment of the invention.

A field emission display according to the invention is shown in FIGS. 6–9. The display comprises a cathode portion 100 and an anode portion 200. The anode and cathode portions are spaced from each other and are hermetically sealed at the perimeter to form a cavity (not shown). The cavity formed between the two portions is evacuated with a typical vacuum pressure of about $10^{-6}$ Torr. Techniques for sealing and evacuating the cavity are well known in the art.

The anode portion 200 of the display comprises a vacuum compatible substrate 70 made from materials such as glass, ceramic, metal, or silicon. When substrate 70 comprises electrically insulating or semiconducting materials such as glass, silicon or ceramic, an electrically conductive anode 72 is formed on one surface of substrate 70. Anode 72 is typically formed from a highly conductive and reflective material such as aluminum. This material is typically deposited by vacuum means such as evaporation or sputtering to coat the entire surface of substrate 70 or a portion thereof. Regions 31 of a coating material capable of emitting light when stimulated by electron current is formed on the electrically conducting portions of anode 72. This material is typically a cathodoluminescent phosphor such as ZnO:Zn but can be other materials or combinations of materials such as organic electroluminescent films.

Each cathode 100 comprises a portion 67 and a portion 65. Portion 67 lies within, and is substantially enclosed by portion 65, FIG. 7. A first defining characteristic of portion 67 is high transmissivity of light in a specific wavelength passband. This generally spans the wavelengths from 400 nm to 700 nm for visibility in the regions sensitive to the human eye, but does not exclude other wavelengths. A second defining feature of portion 67 is that it comprises an array of electron-emitting elements, two of which are shown, disposed with substantially uniform spatial distribution. The portion 65 has low electrical resistivity, typically in the range of 2–10 micro-ohm cm.

Figure 8:
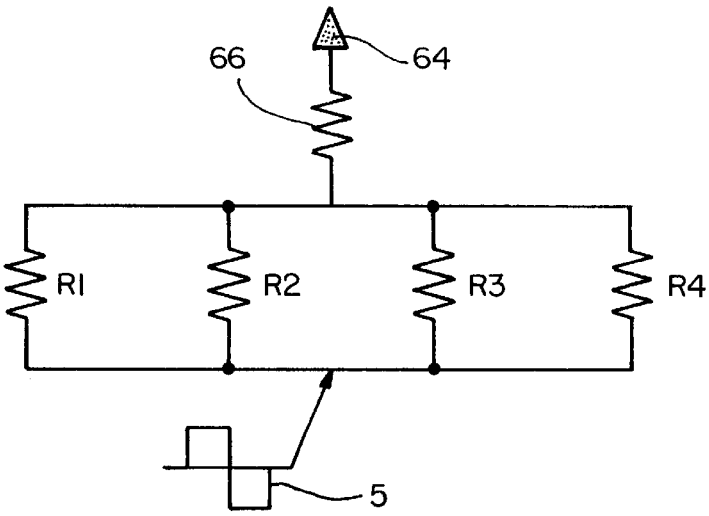
FIG. 8 is a schematic illustration of the ballast resistor in series with the reduced parallel distributed resistance of the first transparent conductive electrode.

As was previously discussed, the electrical resistance from an electrical signal source 5 to any electron-emitting element 64 must be made small so that the signal quality from the signal source to the electron emitter is not degraded. The low resistivity region 65 provides a minimized electrical path from signal source 5 to any electron emitter 64. In addition, the equivalent electrical circuit shown in FIG. 8 represents the electrical resistance from signal source 5 to any electron emitter element 64 as a parallel resistive circuit. This has the effect of reducing the total resistance from signal source to electron emitter by the sum of the reciprocal resistances: $1/R_{tot}=1/R_1+1R_2+1/R_3+1/R_4$. This also has the effect of normalizing the resistance from,signal source 5 to any emitter element 64 so that the difference in resistance from emitter to emitter across the cathode is minimized.

Referring again to FIG. 6, cathode portion 67 comprises a first transparent, electrically conductive electrode 61 formed on transparent, electrically insulating substrate 60, and a second transparent conductive electrode 62 spaced away from, and electrically isolated from electrode 61 by transparent, electrically insulating layer 63. Electron-emitting elements 64 are disposed in a substantially spatially uniform array over first transparent conductive electrode 61. Emitter elements 64 are spaced away from electrode 61 by resistive elements 66. Resistive elements 66 are electrically connected to emitter elements 64 and first transparent electrode 61, and function as ballast resistors. The resistance of the ballast resistors 66 is primarily dependent on their thickness. Emitter elements 64 are electrically isolated from second transparent, conductive electrode 62 by via 68. Electrical signal 5 applied between first and second transparent conductive electrodes 61,62 causes electrons to be emitted from electron emitter 64.

Figure 9A:
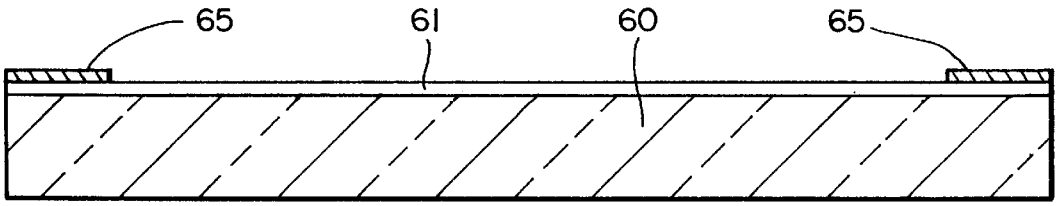
FIGS. 9*a*–9*j* show a method for construction of a transparent field emission cathode with a ballast resistor in series with the distributed resistance of the first transparent conductive electrode.

FIGS. 9*a*–9*j* show a method for constructing a display incorporating the present invention; FIG. 9*a* shows the transparent, electrically insulating substrate 60 coated with a first transparent, conductive electrode 61. Transparent insulating substrate is typically glass of a type manufactured by Schott and identified as type D263. The first transparent conductive electrode is typically Indium Tin Oxide (ITO) coated to a sheet resistance of 10 to 100 Ohms per square. Cathode portion 65 is formed by conventional photolithographic means from low resistivity metal such as aluminum, chromium, copper, molybdenum or gold.

Figure 9B:
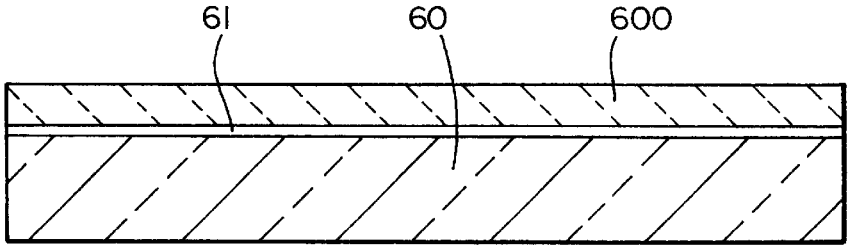

FIG. 9*b* represents the deposition of a blanket layer of resistor material 600 overlying first transparent conductive layer 61. Resistor layer 600 is typically formed from a material such as SiC that is substantially opaque to light in the wavelength passband from 240 nm to 420 nm. Layer 600 is typically deposited by conventional sputtering or chemical vapor deposition (CVD) means.

Figure 9C:
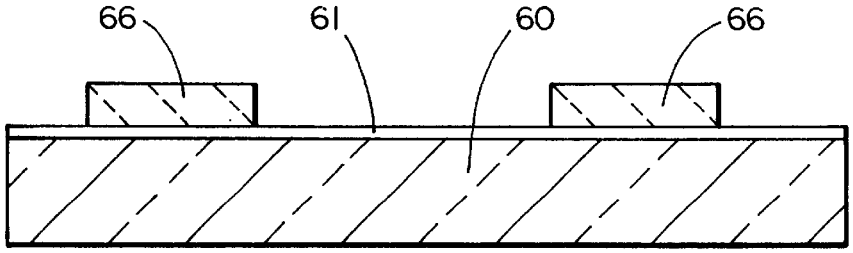

Resistor layer 600 is patterned by conventional photolithographic means in FIG. 9*c* to form ballast resistor 66. Resistor 66 is typically 1 to 1.5 microns in diameter. Resistor layer 600 can be etched by wet or dry means with etchants containing $F^-$ ions. Etching stops when the etching process removes sufficient resistor layer material so as to expose electrode 61. The resistance of resistor 66 is typically $10^4$ to $10^7$ Ohms when measured from electrode 61 to the surface of resistor 66 opposite electrode 61. The resistance is controlled primarily by the thickness.

Figure 9D:
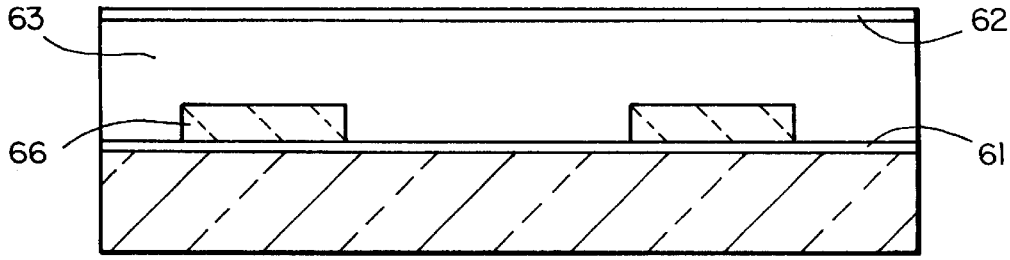

Referring to FIG. 9*d,* transparent insulating layer 63 is deposited to a typical thickness of 300 nm to 500 nm by plasma enhanced chemical vapor deposition (PECVD). The layer overlies conductive electrode 61 and resistor 66. Materials comprising insulating layer 63 are typically silicon dioxide or silicon nitride, but may be other materials with low dielectric constant, good electrically insulating properties, and high optical transmission in the visible wavelength passband. Second transparent conductive electrode 62 is deposited on dielectric layer 63. Material comprising the second transparent conductive electrode is typically ITO with a sheet resistance of 10 to 100 Ohms per square. Second transparent conductive electrode is typically deposited by sputtering.

Figure 9E:
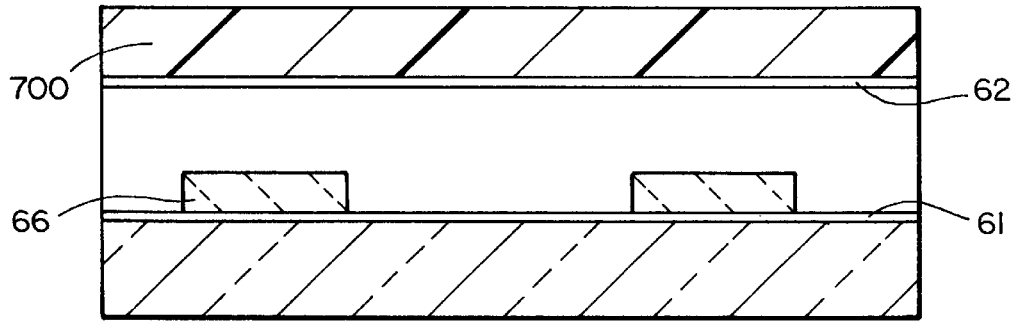

Photoresist 700, FIG. 9*e,* of a negative type whereby the resist polymerizes under exposure to actinic light and becomes insoluble in the developer is deposited by spin coating over second transparent electrode 62. Typical examples of resist include OFPR made by Tokyo Ohka Co. Ltd. or DNR-L300 made by Dongjin Semichem Co. Ltd. Resist is deposited to a thickness of 100–200 nm. Following the coating step, resist is softbaked at 90 deg C. for 2 minutes on a hot plate.

Figure 9F:
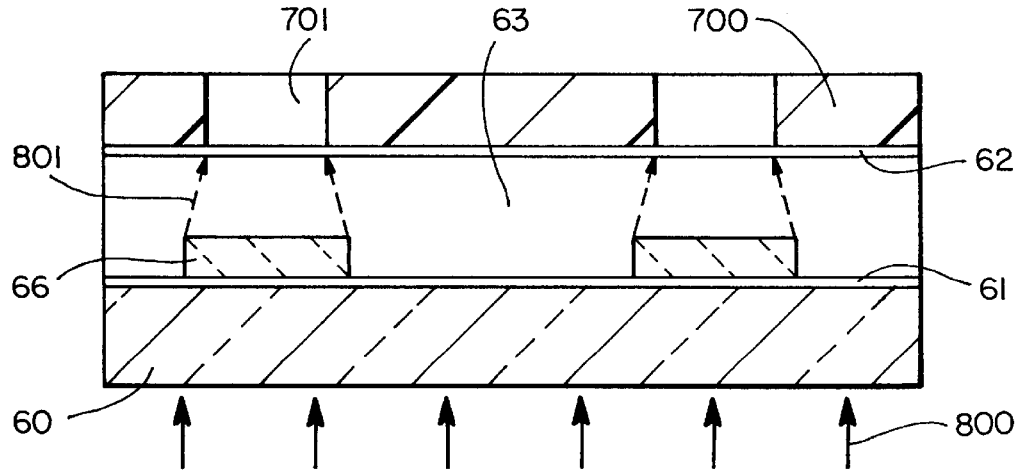

FIG. 9*f* shows the exposure of photoresist 700 by means of actinic light 800 of a typical wavelength of 365 nm, transmitted through transparent substrate 60, first transparent conductive electrode 61, transparent insulating layer 63, and second transparent conductive layer 62. Resistor element 66 is opaque to this wavelength of light and so prevents polymerization in region 701 which is the plane projection of resistive element 66 onto photoresist layer 700. As is well known in the science of optics, light will diffractad scatter edge of a feature such as resistive element 66. This diffractive region 801, causes region 701 to be smaller in diameter than the diameter of resistive element 66. The difference in diameter may be controlled by length of exposure to actinic light 800. This provides for self-alignment of resistive element 66 to feature 701.

Figure 9G:
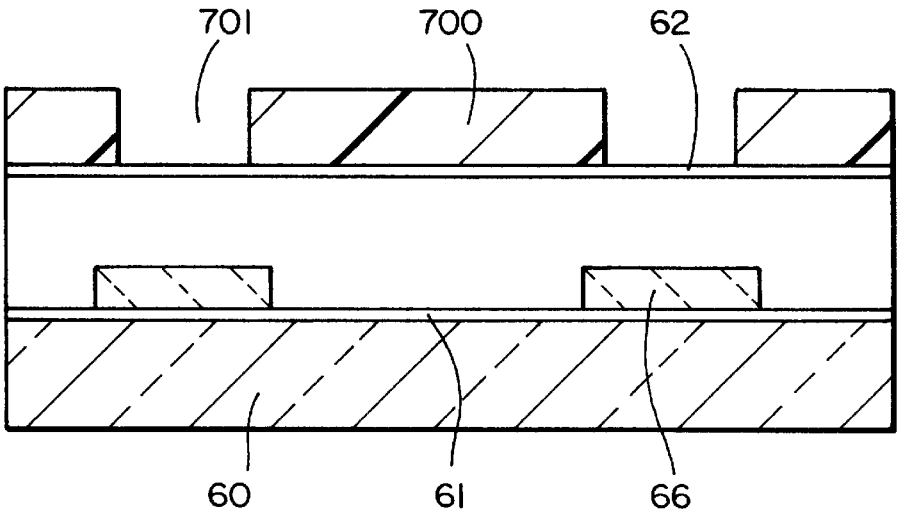

During development in an appropriate solvent, unexposed region 701 of photoresist film 700 is removed to lay bare the portion of second transparent conductive electrode 62 defined by region 701 in FIG. 9*g*.

Figure 9H:
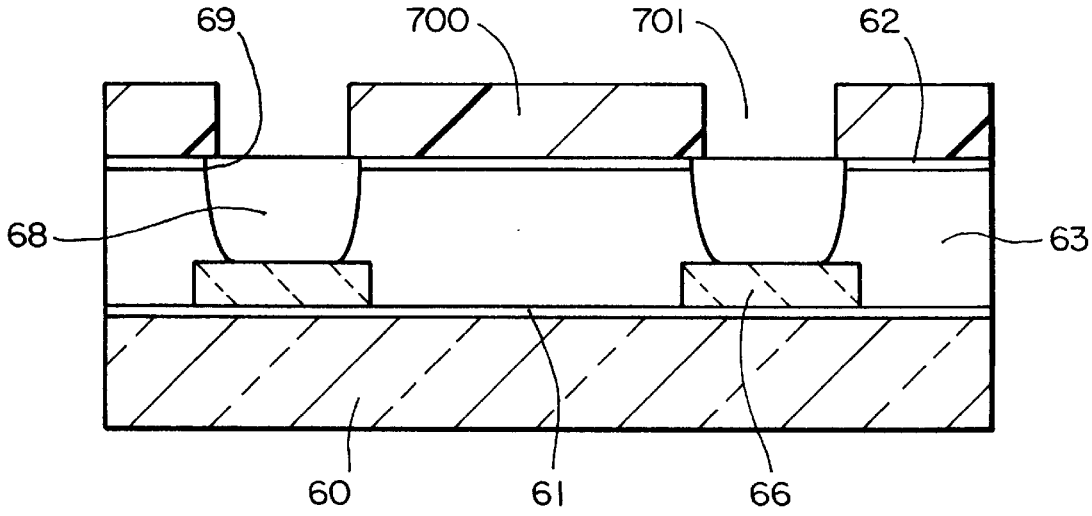
Figure 9I:
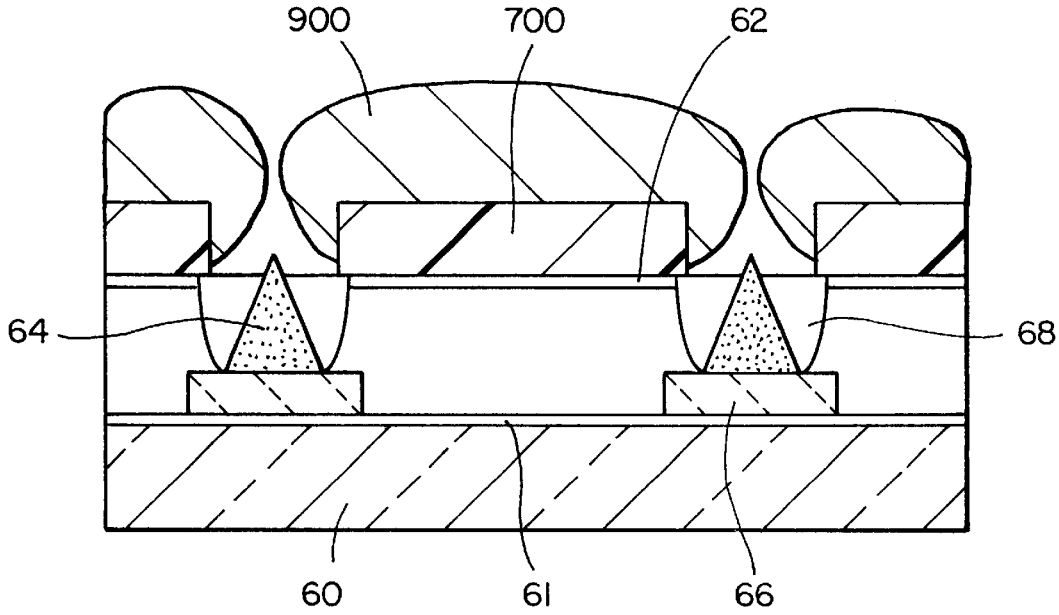

Referring to FIG. 9*h,* second transparent conductive electrode 62 is removed in region 701 by wet or dry etching in commercially available media to form gate 69. Gate 69 is smaller in diameter than resistor element 66. Regions masked by photoresist 700 are not etched. Likewise, transparent insulating layer 63 is etched in region 701 to form via 68. Insulating layer 63 is etched by wet or dry etching means in media containing $F^-$ to stop on resistive element 66.

Electron-emitting element 64 is formed by evaporating metal layer 900 into via 68 and incidentally onto photoresist layer 700. Metal layer 900 is typically molybdenum, evaporated from a restricted source so that the half angle of evaporation is less than 10 degrees. This provides the conical shape of electron emitter 64 due to the closure of region 701 by accumulation of metal 600. This has been described by Spindt. et. al. "Journal of Applied Physics" V47, #12, December 1976.

Figure 9J:
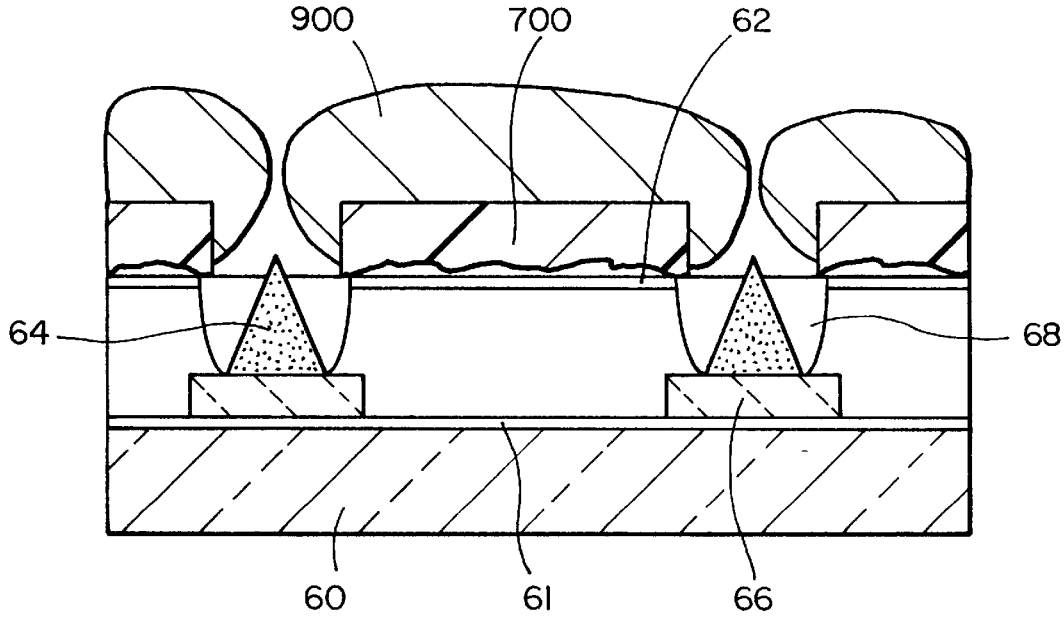
Figure 10A:
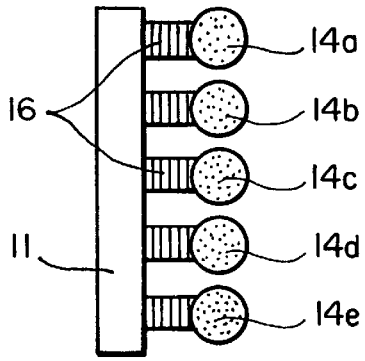
FIGS. 10*a*–10*f* show various processing results, which yield non-uniform resistor configurations.
Figure 10B:
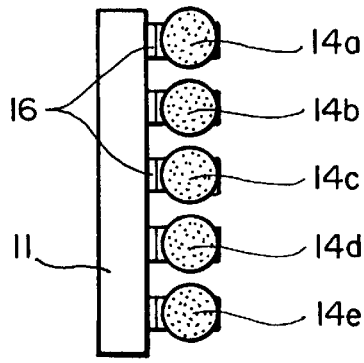
Figure 10C:
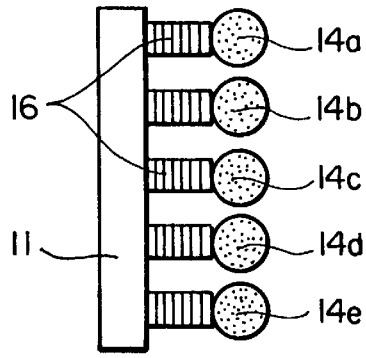
Figure 10D:
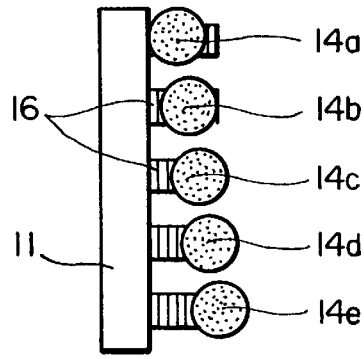
Figure 10E:
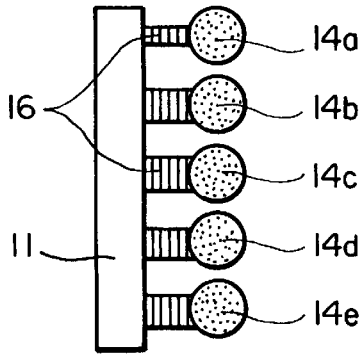
Figure 10F:
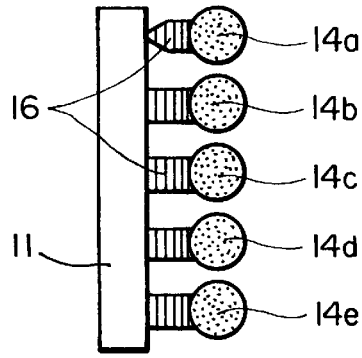

FIG. 9*j* shows the removal of closure layer 900 by etching away photoresist layer 700, or by degrading the adhesion of layer 700 so that closure layer 900 loses mechanical attachment to second transparent electrode 62. This is typically performed by treating in sulfur trioxide.

There has been provided a field emission display which includes a transparent cathode in which the electrical resistance of the electrode between the electron-emitting cone and the source of electrical current is minimized, the resistance of the ballast resistor is controlled primarily by its thickness, and its resistance is in parallel with the resistance of the electrode between the two cones to the source of electrical signal.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A field emission display comprising:

a conductive anode, a light emitting material which emits light in response to electron bombardment carried by said conductive anode, a field emission cathode spaced from said anode including:

a first substantially transparent electrode, a plurality of ballast resistive elements of predetermined thickness disposed on said first electrode, a plurality of electron-emitting elements, one for each resistive element, disposed on said resistive elements whereby the resistive elements are in series with each of said electron-emitting elements, a second substantially transparent conductive electrode spaced from said first conductive electrode, said second conductive electrode having a plurality of holes, one opposite from each of said electron-emitting elements, and a transparent insulating layer between said first and second conductive electrodes.

2. A field emission display as in claim 1 in which said electron-emitting elements are conical, said resistive elements are circular and said holes are circular.

3. A field emission display as in claim 2 in which the diameter of said circular holes is less than the diameter of the circular resistive elements.

4. A field emission display as in claim 1 in which a plurality of said electron-emitting elements are on a portion of said first transparent conductive electrode, and a layer of material having a higher electrical conductivity than said conductive electrode surrounds said electron-emitting elements and is connected to the source of electrical current for said emitting elements.

5. A field emission display as in claim 1 in which said ballast resistive elements are opaque.

* * * * *